US005647323A

United States Patent [19]

Kubo et al.

[11] Patent Number: 5,647,323

[45] Date of Patent: Jul. 15, 1997

[54] FUEL INJECTION SYSTEM

[75] Inventors: Ken-ichi Kubo; Jun Matsubara; Hiroshi Ishiwata, all of Higashimatsuyama, Japan

[73] Assignee: Zexel Corporation, Tokyo, Japan

[21] Appl. No.: 646,908

[22] Filed: May 9, 1996

[30] Foreign Application Priority Data

May 18, 1995 [JP] Japan ..... 7-144013

[51] Int. Cl.[6] ..... F02M 41/00

[52] U.S. Cl. ..... 123/450; 123/500; 417/462

[58] Field of Search ..... 123/502, 501, 123/500, 450; 417/462

[56] References Cited

U.S. PATENT DOCUMENTS

| | | | |
|---|---|---|---|
| 2,935,062 | 5/1960 | Aldinger et al. . | |
| 4,376,432 | 3/1983 | Davis | 417/462 |
| 4,441,474 | 4/1984 | Jarrett | 123/450 |
| 4,572,137 | 2/1986 | Nakatsuka | 123/450 |
| 4,662,537 | 5/1987 | Eheim | 417/462 |
| 4,751,903 | 6/1988 | Cabarroca's et al. | 123/450 |
| 5,115,783 | 5/1992 | Nakamura et al. . | |
| 5,513,965 | 5/1996 | Nakamura | 417/462 |

FOREIGN PATENT DOCUMENTS

| | | | |
|---|---|---|---|
| 1209065 | 12/1956 | France | 123/450 |
| 35 24 387 | 1/1986 | Germany . | |
| 0243363 | 12/1985 | Japan | 123/450 |
| 1588629 | 4/1981 | United Kingdom . | |

*Primary Examiner*—Carl S. Miller

*Attorney, Agent, or Firm*—Wenderoth, Lind & Ponack

[57] ABSTRACT

The movement of a control sleeve in the circumferential direction is made to interlock with the movement of a timer piston to ensure that the control sleeve has a function of pre-stroke control. In order to interlock the movements of the timer piston and the control sleeve, they are linked with first through third link members and the control sleeve is caused to rotate in the circumferential direction at a specific ratio relative to the quantity of movement of the timer piston. In a fuel injection system provided with an actuator for adjusting the fuel force feed end by moving the control sleeve in the direction of the axis and an actuator for controlling the timing with which the cam lift begins, pre-stroke control can be achieved without requiring a separate actuator, with a simple mechanical structure.

14 Claims, 5 Drawing Sheets

FUEL INJECTION SYSTEM

BACKGROUND OF THE INVENTION

1. Field of the Invention

The present invention relates to a fuel injection system provided with a timer mechanism and a control sleeve, such as a VR pump (an inner-cam distributor type fuel injection pump provided with plungers at a rotor that rotates in synchronization with an engine, facing opposite each other in the direction of the radius of the rotor, to compress and inject fuel by causing the plungers to make reciprocal movement with the inner-cam) and a VE pump (a distributor type fuel injection pump with a rotor that rotates in synchronization with an engine being caused to make reciprocal movement itself relative to a plunger barrel by a cam disk to compress and inject fuel) and, in particular, it relates to a fuel injection system provided with a pre-stroke control mechanism.

2. Description of the Related Art

This type of fuel injection system includes the one disclosed in, for instance, Japanese Unexamined Patent Application No. S61-23832, in which a cam disk 29 is placed in contact with a roller 32 that is held by a roller ring 31. A plunger 26, which faces a plunger high pressure chamber 25, is secured to the cam disk 29 and is caused to make rotating and reciprocal movements by the cam disk 29, which rotates in synchronization with an engine. In the plunger 26, a through hole 50, through which fuel is taken into the plunger high pressure chamber 25 from a pump chamber 22 during the intake process, a distribution port 35, through which fuel pressurized in the plunger high pressure chamber 25 is delivered during the force feed process, and spill ports 51 and 52 for cutting off the fuel delivery, are formed. Fuel supplied to the plunger high pressure chamber 25 is compressed with the reciprocal movement of the plunger 26, and the fuel thus compressed is distributed with the reciprocating movement of the plungers 26.

A control sleeve 53 is externally fitted on the plunger 26 covering the spill ports 51 and 42, and by moving this control sleeve 53 in the direction of the axis, the fuel injection quantity is varied by changing the fuel force feed end timing and, at the same time, by rotating the control sleeve 53 in the circumferential direction, the start timing of fuel force feed, i.e., the length of time elapsing from the start of cam lift until the start of fuel force feed (pre-stroke), is controlled. In addition, the cam lift start timing is adjusted by varying the positional relationship between the cam disk 29 and the roller 32.

In the fuel injection system described above, because of its structural features, the fuel force feed end timing, the cam lift start timing and the fuel force feed start timing can be controlled independently of one another and a number of advantages are achieved, such as: (1) the injection pressure can be increased to reduce the generation of black smoke and NOx by setting the injection period during high load operation in the low rotation speed range or during partial load operation (partial operation, medium load operation) in a range over which the cam speed is high; (2) if it is necessary to reduce the size of the nozzle hole of the injection nozzle to conform to exhaust gas regulations, it is possible to extend the range over which cam lift is in effect during high rotation speed, high load operation, and; (3) since the injection timing can be practically modified by adjusting the fuel force feed start timing as well as adjusting the cam lift start timing, the range over which the injection timing can be adjusted freely is extended. However, since the structure described above requires that an actuator for controlling the fuel force feed start timing be provided separately, apart from an actuator for controlling the fuel force feed end timing and an actuator for controlling the cam lift start timing, the number of actuators increases, making the control more complicated and increasing the production cost.

SUMMARY OF THE INVENTION

Reflecting the problems discussed above, an object of the present invention is to provide a fuel injection system with which the three advantages described above can be achieved by controlling the start of fuel force feed with a simple mechanical structure without providing an independent actuator and while retaining the actuators provided in the prior art for controlling the fuel force feed end timing and the cam lift start timing.

Accordingly, a distributor type fuel injection pump according to the present invention comprises an advance angle adjusting actuator that sets a required advance angle by shifting a cam surface and an injection quantity adjusting actuator that sets a required injection quantity by displacing a control sleeve in the direction of the axis. In this fuel injection pump, the movement of the control sleeve in the circumferential direction is interlocked with the movement of the advance angle adjusting actuator so that the control sleeve will have a pre-stroke control function.

A desirable mode in which the movement of the control sleeve in the circumferential direction is interlocked with the movement of the advance angle adjusting actuator will be to link the advance angle adjusting actuator and the control sleeve with a link member to ensure that the control sleeve is caused to move in the circumferential direction at a specific ratio to the quantity of movement of the advance angle adjusting actuator. As a specific structure of the link member for achieving this, the link member may comprise a first link member that rotates as the advance angle adjusting actuator moves, a second link member provided with a first arm portion that interconnects with the first link member, which rotates as the first link member rotates, and a third link member that is secured at the second link member and is provided with a second arm portion that interconnects with the control sleeve, with the radius of the rotation of the second arm portion being larger than the radius of the rotation of the first arm portion.

In addition, in order to achieve a structure in which the pre-stroke is varied by moving the control sleeve in the circumferential direction, a hole for taking in and discharging fuel is provided in the control sleeve.

Consequently, the cam lift start timing is adjusted with the advance angle adjusting actuator and the injection quantity is adjusted with the injection quantity adjusting actuator by moving the control sleeve in the direction of the axis. Also, since the movement of the control sleeve in the circumferential direction is made to interlock with the movement of the advance angle adjusting actuator, the pre-stroke is controlled at the same time in relation to the control of the timing with which cam lift starts, which eliminates the necessity for controlling the pre-stroke separately, achieving the object described above.

BRIEF DESCRIPTION OF THE DRAWINGS

The above and other features of the present invention and concomitant advantages will be better understood and appreciated by persons skilled in the field to which the invention pertains in view of the following description given in conjunction with the accompanying drawings, which illustrate preferred embodiments. In the drawings.

DETAILED DESCRIPTION OF THE PREFERRED EMBODIMENT

The following is an explanation of an embodiment of the present invention in reference to the drawings.

Figure 1:
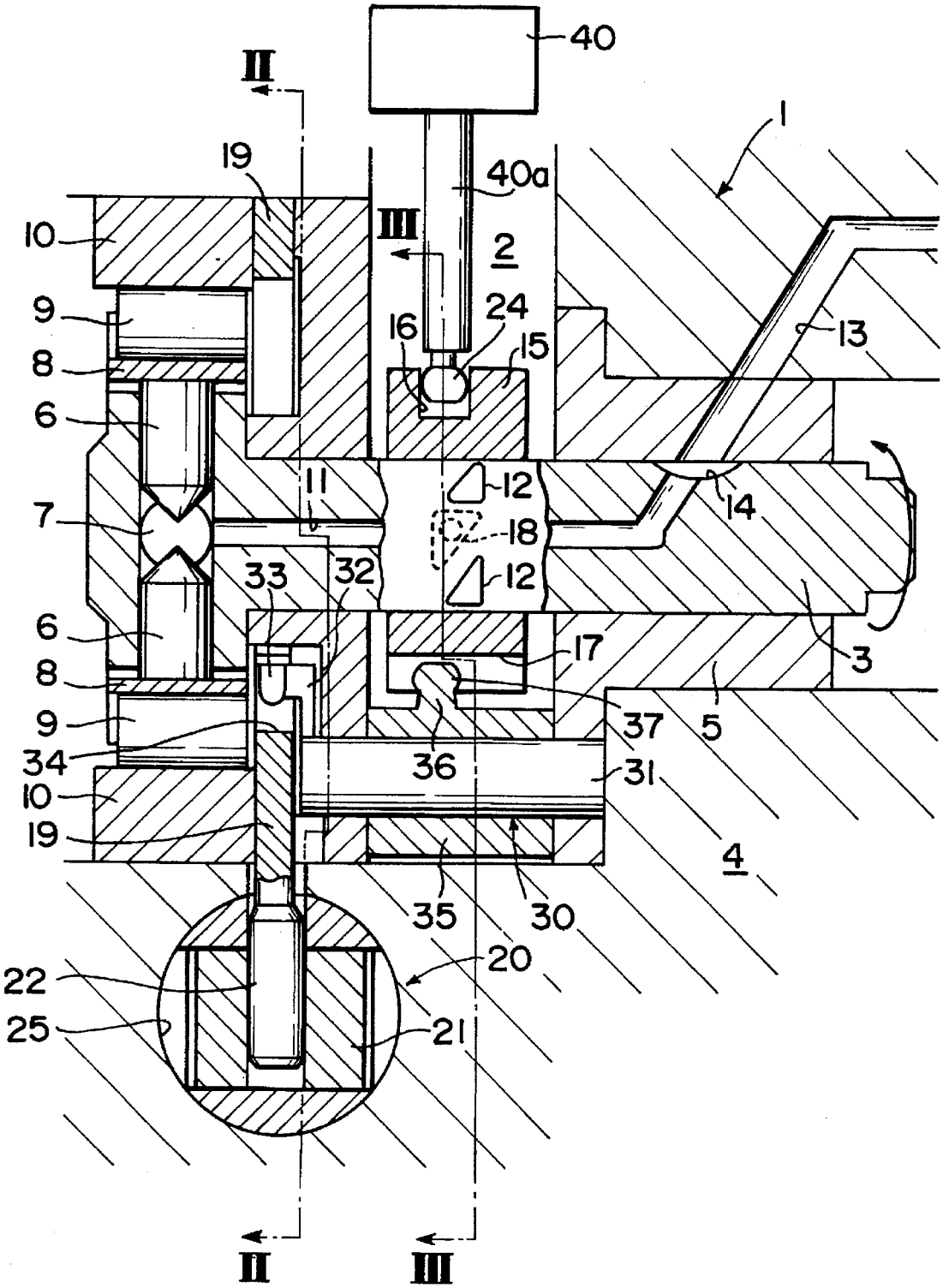
FIG. 1 is a cross section of an essential portion of a VR type distributor type fuel injection system in which the present invention is adopted.

In FIG. 1, which shows an essential portion of an inner-cam distributor type fuel injection pump, fuel is induced into a chamber 2 via a feed pump (not shown) in a distributor type fuel injection pump 1, with a distribution member 3 provided extending across the chamber 2. The front end portion of the distribution member 3 is inserted in a barrel 5 which is secured at a pump housing 4 in such a manner that it can rotate freely. The base end portion of the distribution member 3 is linked to a drive shaft via a coupling so that it is only allowed to rotate in synchronization with an engine. In addition, at the base end portion of the distribution member 3, plungers 6 are inserted in the direction of the radius (radial direction) in such a manner that they can slide freely.

In this embodiment, four plungers 6 are provided on the same plane over, for instance, 90° intervals. The front end of each plunger 6 faces a compression space 7 provided at the center of the base end portion of the distribution member 3, blocking off the compression space 7. The bottom end of the plunger 6 is made to slide against an internal surface of a ring-like cam ring 10 via a shoe 8 and a roller 9. The cam ring 10 is provided surrounding and concentrically to the distribution member 3, and is provided with cam surfaces on the inside, the number of which corresponds to the number of cylinders in the engine. When the distribution member 3 rotates, each plunger 6 makes reciprocal movement in the direction of the radius (radial direction) of the distribution member 3 to vary the volumetric capacity of the compression space 7.

In the distribution member 3, a longitudinal channel 11 is formed in the direction of its axis to communicate with the compression space 7. Inflow/outflow ports 12 communicating with the longitudinal channel 11, the number of which corresponds to the number of cylinders, are formed opening on the circumferential surface of the distribution member 3, and a distribution port 14 is formed which allows communication between the longitudinal channel 11 and distribution passages 13 formed in the barrel 5 and the pump housing 4. The openings of the inflow/outflow ports 12 on the surface of the distribution member 3 are formed in a triangular shape with the side toward the rear in the direction of rotation running parallel to the axis of the distribution member 3 and the side toward the from in the direction of rotation inclined at a specific angle relative to the axis of the distribution member 3. In addition, a control sleeve 15, provided inside a chamber, is externally fitted on the distribution member 3 covering the inflow/outflow ports 12 in such a manner that it can slide freely.

A lateral groove 16 extending in the direction running at a right angle to the axis of the distribution member 3 is formed at the upper end portion of the control sleeve 15 and a longitudinal groove 17 extending parallel to the center of the axis of the distribution member 3 is formed at the lower end portion. Moreover, an intake cutoff hole 18, which can communicate with the inflow/outflow ports 12 of the distribution member 3, is formed at the control sleeve 15. The portion of the intake cutoff hole 18 that opens at the internal surface of the distribution member 3 is formed in a triangular shape, with the side that determines the timing with which it starts to communicate with an inflow/outflow port 12 inclined at a specific angle relative to the axis of the distribution member 3 and the side that determines the timing with which the communication with the inflow/outflow port 12 ends running parallel to the axis of the distribution member 3. A decentered ball 24 provided at the front end of a shaft 40*a* of an electric governor 40 is fitted in the lateral groove 16, and when the shaft rotates with a signal from the outside, the control sleeve 15 is caused to move in the direction of the axis of the distribution member 3.

Figure 2:
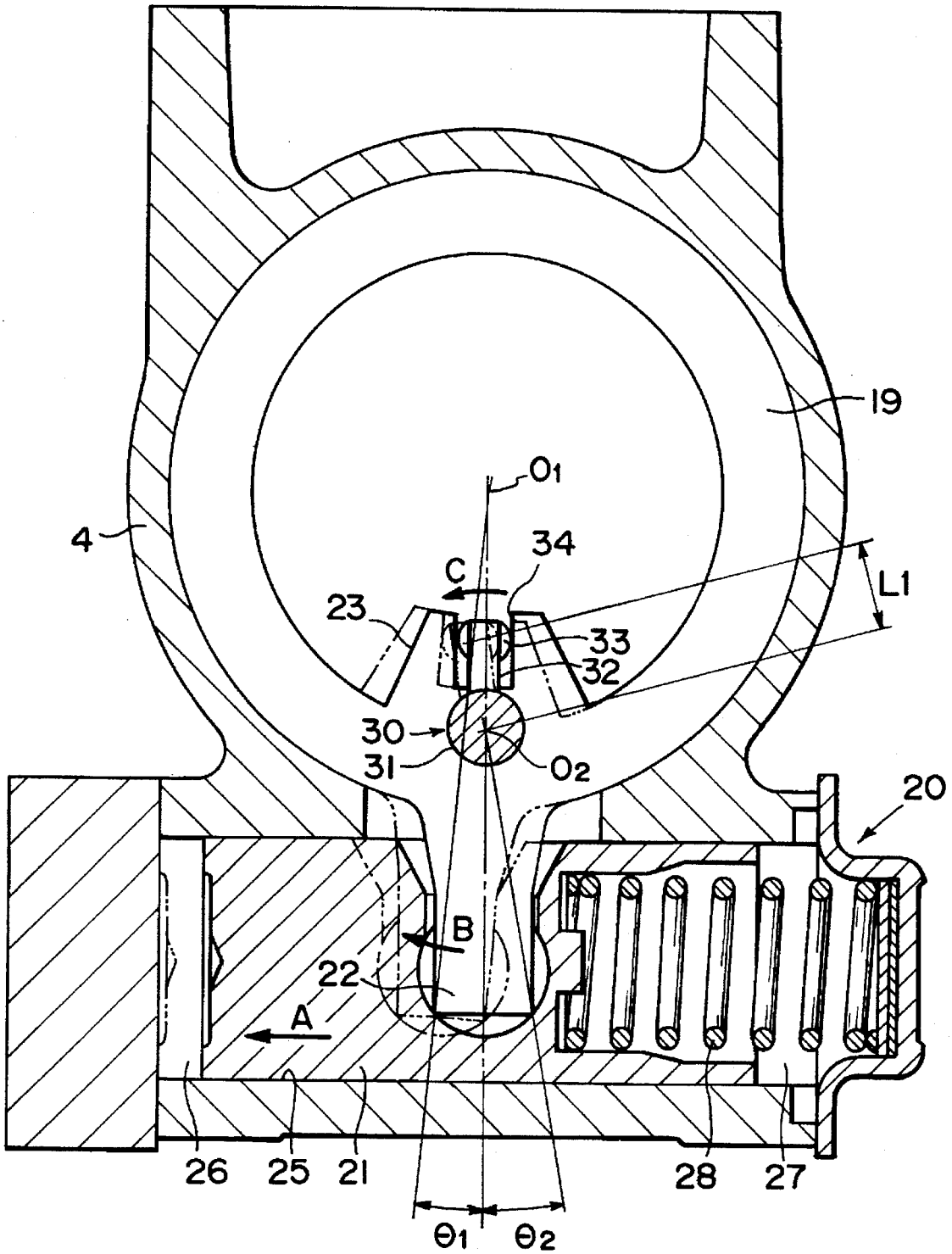
FIG. 2 is a cross section of the fuel injection system in FIG. 1 through line II—II.

A ring-like first link member 19, which interlocks with a timer piston 21 of a timer mechanism 20, to be detailed below, is secured at the cam ring 10. As shown in FIG. 2, the lower portion of the external circumferential edge of this first link member 19 extends downward to form a slide pin 22, which is linked to the timer piston 21, and a connecting and locking piece 23 is formed in the lower portion of the internal circumferential edge, extending toward the center of rotation $O_1$.

The timer mechanism 20 is provided with the timer piston 21, which is housed in a cylinder 25 provided at the lower end of the first link member 19 in such a manner that it can slide freely. The slide pin 22 is connected by insertion into this timer piston 21 from the direction of the radius, and the movement of the timer piston 21 is converted to a rotating movement of the first link member 19 so that the secured cam ring 10 to which the first link member 19 is secured, is caused to rotate to change the injection timing.

At one end of the timer piston 21, a high pressure chamber 26 is formed, into which high pressure fuel in the chamber is induced, and at the other end, a low pressure chamber 27 is formed, which communicates with an intake path of the feed pump. Moreover, a timer spring 28 is provided in the low pressure chamber 27, and this timer spring 28 applies a constant force to the timer piston 21 toward the high pressure chamber. Consequently, the timer piston 21 stops at a position where the spring pressure of the timer spring is in balance with the pressure inside the high pressure chamber, and when the pressure in the high pressure chamber increases, the timer piston 21 moves toward the low pressure chamber against the force of the timer spring 28. The cam ring 10 is caused to rotate in the direction in which the injection timing is hastened, to advance the injection timing.

In contrast, when the pressure in the high pressure chamber is lowered, the timer piston 21 moves toward the high pressure chamber and the cam ring 10 is caused to rotate in the direction in which the injection timing is delayed, to retard the injection timing. Note that the pressure in the high pressure chamber 26 at the timer is adjusted by a timing control valve (TCV) so that the required timer advance angle can be achieved.

As shown in FIG. 1, a second link member 30 which is held relative to the pump housing 4 is provided under the control sleeve 15. This second link member 30 is constituted with a base shaft portion 31, which is supported by the the pump housing 4, and a first arm portion 32, which extends from the base shaft portion 31 in the direction of the radius. An interconnecting projected portion 33, which extends parallel to the axis of the base shaft portion 31, is provided at the from end of the first arm portion 32 and the length of the first arm portion 32 in the direction of the radius (the distance from the center of the base shaft portion 31 to the center of the connecting projected portion 33) is a specific, preset length L1, as shown in FIG. 2. In addition, the interconnecting projected portion 33 of the first arm portion 32 is connected to an indented portion 34 formed in the connecting and locking piece 23 of the first link member 19.

The base shaft portion 31 of the second link member 30 is provided vertically to the first link member 19 and its center $O_2$ is set between the center of rotation $O_1$ of the first link member 19 and the timer piston 21. When the timer piston 21 is positioned almost at the center of the cylinder 25, the central line of the slide pin 22 will be almost aligned with a hypothetical line passing through $O_1$ and $O_2$, and the first arm portion 32 will extend from $O_2$ toward $O_1$.

Figure 3:
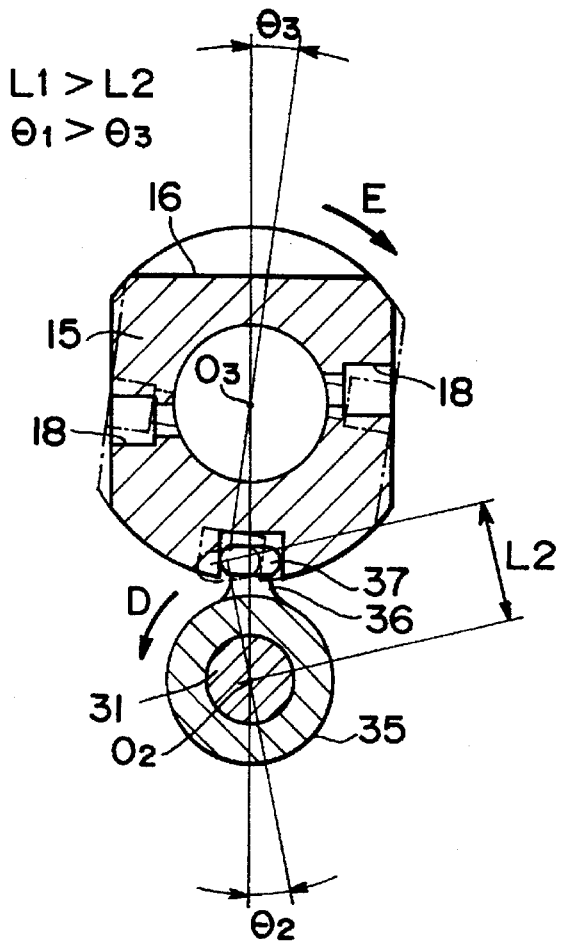
FIG. 3 is a cross section of the fuel injection system in FIG. 1 through line III—III.

As shown in FIG. 3, a third link member 35 is externally fitted on the base shaft portion 31 of the second link member 30 tightly, so that when the base shaft portion 35 rotates, the third link member 31 also rotates. A second arm portion 36, extending in the same direction as the first arm portion 32, is formed at the third link member 35, and an interconnecting ball 37 formed at the front end of the arm portion 36 is fitted in the longitudinal groove 17 formed at the lower end of the control sleeve 15.

The length of the arm of this second arm portion 36 (the distance from the center $O_2$ of the base shaft portion 31 to the center of the interconnecting ball 37), too, is preset at a specific length L2, and when the timer piston 21 is positioned almost at the center of the cylinder 25, the second arm portion 36 is in a state in which it extends from $O_2$ toward the center (the axis of the distribution member 3) $O_3$ of the control sleeve 15. In addition, the length L2 of the second arm portion is set larger than the length L1 of the first arm portion.

Figure 4A:
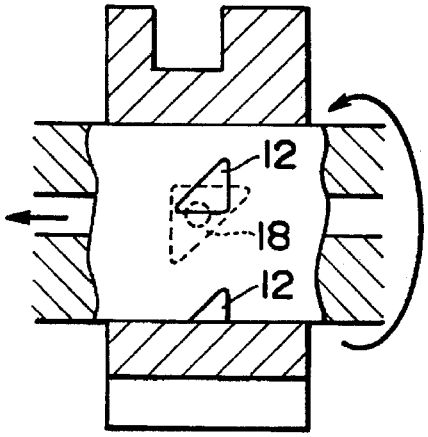
FIGS. 4A, 4B and 4C show changes in the positional relationship between an inflow/outflow port 12 and an intake cutoff hole 18 that occur as the distribution member rotates, with FIG. 4A illustrating fuel intake, FIG. 4B illustrating fuel injection and FIG. 4C illustrating fuel cutoff.

When the distribution member 3 rotates in the structure described above, the plungers 6 are caused to make reciprocal movement by the cam ring 10 in the direction of the radius of the distribution member 3. The inflow/outflow ports 12 then sequentially communicate with the intake cutoff hole 18 and, during an intake process, in which the plungers 6 move away from the center of the cam ring 10, an inflow/outflow port 12 is aligned with the intake cutoff hole 18 (see FIG. 4A) so that the fuel inside the chamber is taken into the compression space 7.

Figure 4B:
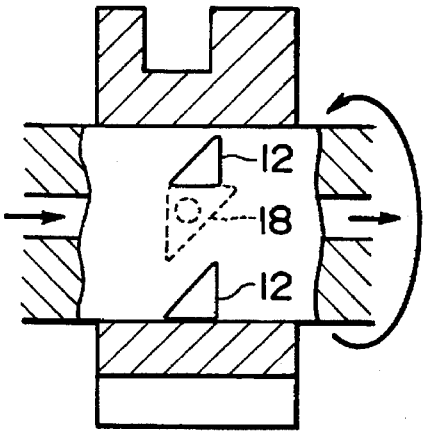

Then, when the operation enters a force feed process, in which the plungers 6 move toward the center of the cam ring 10, the communication between the inflow/outflow port 12 and the intake cutoff hole 18 is cut off (see FIG. 4B), the distribution port 14 becomes aligned with one of the distribution passages 13 and the compressed fuel is discharged to a delivery valve via this distribution passage 13. Note that the fuel delivered through the delivery valve is sent to an injection nozzle via an injection tube (not shown) and from the injection nozzle it is injected into a cylinder of the engine.

Figure 4C:
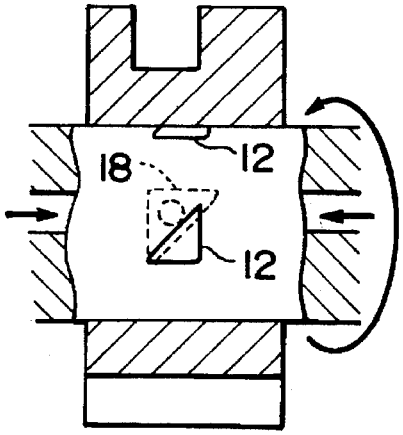

Then, when the next inflow/outflow port 12 communicates with the intake cutoff hole 18 during the force feed process (see FIG. 4C), the compressed fuel flows out into the chamber 2, the delivery of fuel to the injection nozzle is stopped and the injection is ended. Consequently, the rotating angle traversed from the point at which the intake cutoff hole 18 cuts off communication with the inflow/outflow port 12 to the point at which it comes into communication with the next inflow/outflow port 12 constitutes an effective stroke.

Since the inflow/outflow ports 12 and the intake cutoff hole 18 are formed in triangular shapes as explained earlier, the timing with which an inflow/outflow port 12 and the intake cutoff hole 18 communicate with each other can be adjusted by adjusting the position of the control sleeve 15. In other words, the injection end, i.e., the injection quantity, can be adjusted through positional adjustment of the control sleeve 15 and, as the control sleeve 15 is moved further toward the left in the figure (further toward the base end portion of the distribution member 3), the injection quantity increases. As it is moved further toward the right (further toward the front end portion of the distribution member 3) the injection quantity is reduced.

Figure 5:
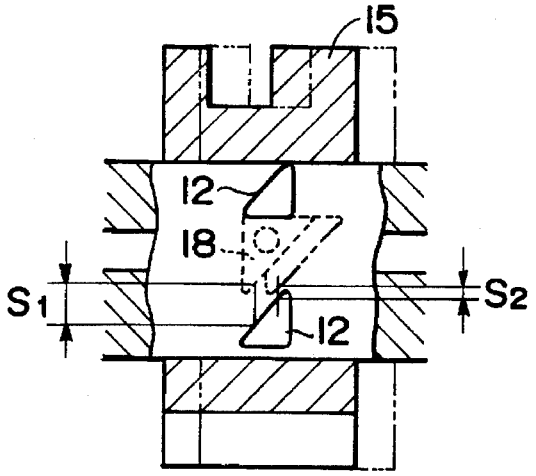
FIG. 5 illustrates the positional relationship between the inflow/outflow port 12 and the intake cutoff hole 18 when the position of the control sleeve is adjusted in the direction of the axis.

To give a more detailed explanation: when the control sleeve 15 is set at a large injection quantity position, the effective stroke S1 is large, as indicated with the solid lines in FIG. 5, thereby lengthening the injection period which, in turn, increases the injection quantity. In contrast, when the control sleeve 15 is set at a small injection quantity position, the hypotenuse of the intake cutoff hole 18 approaches the hypotenuse of the inflow/outflow port 12, as indicated with the 2-point chain lines in FIG. 5, and, as a result, the effective stroke $S_2$ is reduced ($S_2<S_1$), thereby shortening the injection period and reducing the injection quantity.

If the control sleeve 15 only moves in the direction of the axis of the distribution member 3 without changing its phase relative to the cam ring 10, the period of time elapsing after the plungers 6 begin to lift until the communication between the inflow/outflow port 12 and the intake cutoff hole 18 is cut off to start the injection (pre-stroke) does not change and only the injection period is varied. In such injection control, even during full load (high load) operation or partial (partial load, medium load) operation at low speed, the low speed range of the cam will be used, as in the case of high speed, high load operation. This results in a problem in that the injection pressure cannot be raised sufficiently. However, according to the present invention, the pre-stroke can be changed by changing the timer piston position and the injection period during medium or high load operation at low speed can be allocated to the high speed range of the cam.

In other words, when the timer piston 21 is moved in the retard direction (direction A in FIG. 2), for instance, and the first link member 19 is rotated by $\theta_1$ in direction B around $O_1$, the cam ring 10 also rotates by $\theta_1$. The first arm 32, which is fitted in the indented portion 34 of the connecting and locking piece 23, then rotates around $O_2$ by $\theta_2$ in direction C (see FIG. 2). Since the third link member 35 rotates together with the second link member 30, when the second link member 30 rotates by $\theta_2$, the second arm portion 32 also rotates by $\theta_2$ in direction D around $O_2$, which, in turn, causes the control sleeve 15, which is interconnected with the second arm portion 36, to rotate by $\theta_3$ in direction E around $O_3$ (see FIG. 3). When this happens, since the center $O_1$ of the first link member 19 aligns with the center $O_3$ of the control sleeve 15 and the length L2 of the second arm portion 36 is greater than the length L1 of the first arm portion 32, the rotating angle $\theta_3$ of the control sleeve 15 is greater than the rotating angle $\theta_1$ of the first link member 19. Consequently, if the timer piston 21 is moved to rotate the cam ring 10 by $\theta_1$ in the retard direction, the timing with which the plungers start to lift is delayed and the control sleeve 15 rotates further than $\theta_1$ by $(\theta_3-\theta_1)$ to increase the pre-stroke so that the injection starts after the cam high speed range is reached.

In addition, if the timer piston 21 is moved toward the advance side (opposite of direction A), the cam ring 10 rotates in the advance direction to hasten the timing with which the plungers 6 start to lift, to reduce the pre-stroke so that the injection starts from the cam low speed range. Note that the variable margin through which the pre-stroke may be varied is 2 ($\theta_3$ max–$\theta_1$ max) when the maximum angle of inclination at which the slide pin 22 inclines from a hypothetical line passing through $O_1$ and $O_2$ is designated $\theta_1$ max and the rotating angle of the control sleeve 15 at that time is designated $\theta_3$ max.

Figure 6:
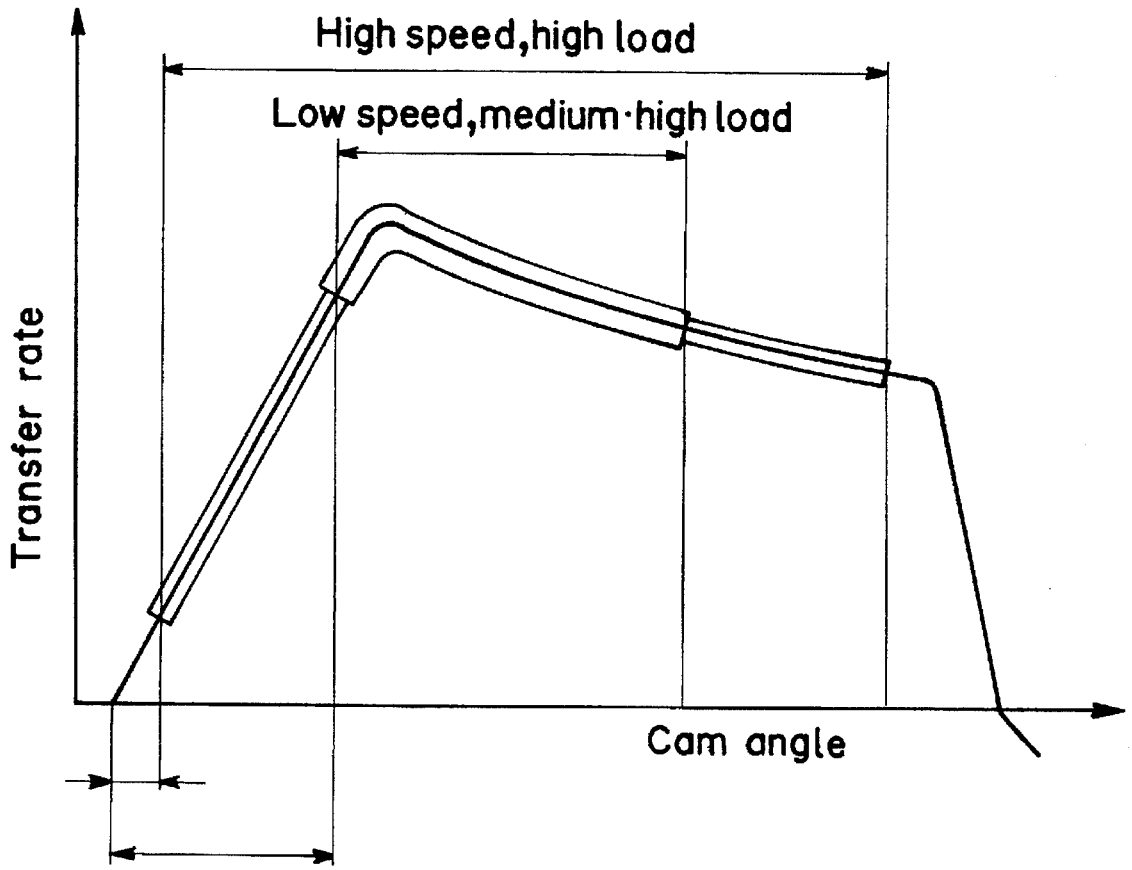
FIG. 6 is a characteristics curve showing the relationship between the transfer rate and the cam angle with the injection period changed in correspondence to the pump rotation rate and the load.

To summarize the above, with the timer set toward the advance side and the control sleeve 15 set in the direction in which the injection quantity increases during high speed, high load operation, the pre-stroke is small at $\alpha$, as shown in FIG. 6, and the range over which cam lift is in effect during injection is extended, ranging from the low speed range through the second half of the high speed range. In contrast, with the timer set toward the retard side during low speed, medium high load operation, the pre-stroke is large at $\beta$, and the injection will start after the cam high speed range is reached, making it possible to increase the injection pressure. As a result, sufficient torque can be achieved even in the low speed, high load range and, moreover, an improvement in fuel consumption and a reduction in the generation of black smoke is achieved. Furthermore, by increasing the injection pressure in the low speed, medium load range, the quantity of exhaust gas circulated is increased, thus reducing NOx.

In addition, although, in the prior art, the injection timing cannot be changed beyond the range affected by the stroke of the timer piston 21, the injection timing can be changed within the range in which the variable margin $(\theta_3-\theta_1)$ of the pre-stroke is added to the timer piston stroke, in the present invention, practically expanding the degree of freedom over which the injection timing can be varied.

Figure 7A:
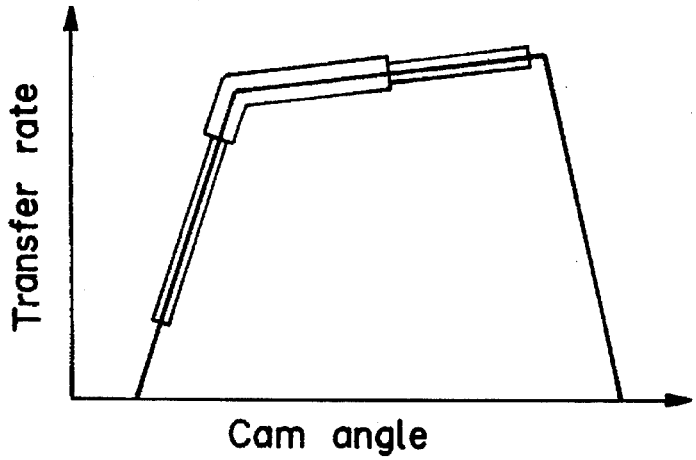
FIGS. 7A~7C show characteristics curves illustrating the relationship between the transfer rate and the cam angle.
Figure 7B:
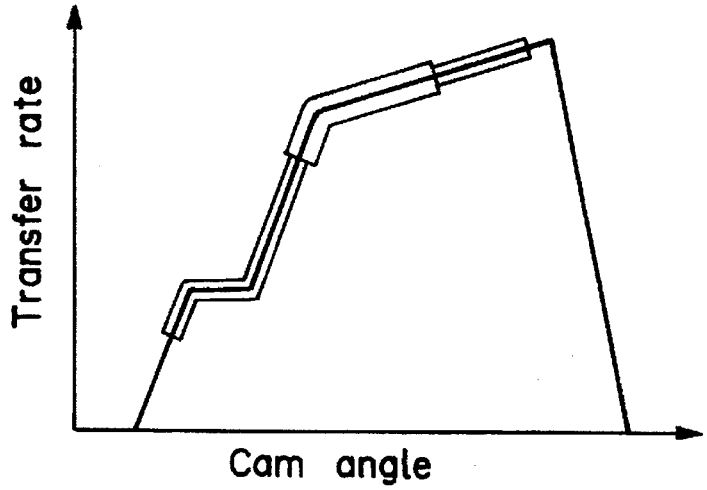
Figure 7C:
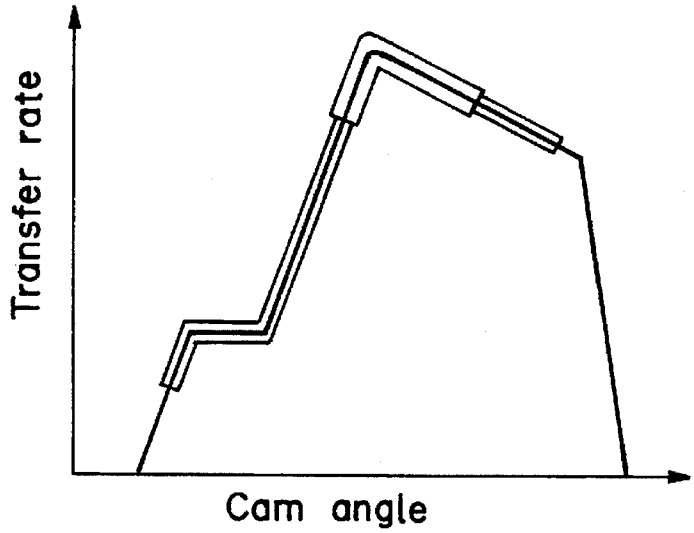

Note that in a structure such as described above, the injection period during low speed, medium high load operation can be allocated to the high speed portion of the cam and the injection period during high speed, high load operation can be allocated starting from the low speed portion of the cam, even when the characteristics vary as shown in FIGS. 7A through 7C as long as the transfer rate is low during the initial period of lift and it increases at approximately the middle, achieving similar advantages to those achieved in the embodiment described earlier. Also, while the number of inflow/outflow ports 12 formed on the plunger side in this embodiment corresponds to the number of cylinders, it may be the number of intake cutoff holes 18 formed on the control sleeve side that corresponds to the number of cylinders. Furthermore, while the embodiment described above is explained in terms of a VR type injection pump, the timer piston and control sleeve may be made to interlock with each other in the same manner in a VE type injection pump to increase the pre-stroke quantity when the timer is retarded and to reduce the pre-stroke quantity when the timer is advanced.

As has been explained, according to the present invention, pre-stroke control is interlocked with cam lift start timing control and adjustment of the advance angle state and adjustment of the pre-stroke are performed simultaneously through control of the advance angle adjusting actuator, achieving pre-stroke control without requiring an independent actuator.

Thus, the injection period is allocated to the high speed range of the cam during high load operation or partial load operation (partial operation) at low rotation rate so that the injection pressure is increased to reduce generation of black smoke and NOx, and when the size of the nozzle hole of the injection nozzle must be reduced to conform to exhaust gas regulations, the range over which the cam is engaged can be extended during high speed, high load operation. Furthermore, since the injection timing can be practically adjusted through adjustment of the fuel force feed start timing as well as through adjustment of the cam lift start timing, the degree over which the injection timing can be varied freely is expanded.

What is claimed is:

1. A fuel injection control mechanism in a distributor type fuel injection system, comprising:

a pump housing having a chamber formed therein;

a support member in said pump housing having fuel delivery distribution passages therein;

a fuel distribution member supported inside said pump housing in such a manner that said distribution member can rotate upon receiving a drive torque, said fuel distribution member being supported by said support member and having a longitudinal axis;

a compression mechanism for compressing fuel upon rotation of said distribution member;

a first through hole extending from said chamber formed inside said pump housing and fluidly communicating with said compression mechanism and a second through hole formed in said distribution member that cyclically fluidly communicates said distribution passages with said compression mechanism upon rotation of said distribution member;

a cam member mounted for rotation relative to said pump housing around the longitudinal axis of said distribution member, said cam member having cam surfaces engaging said compression mechanism;

a first actuator connected with said cam member such that said cam surfaces of said cam member can be shifted in a circumferential direction relative to said pump housing to adjust an advance angle state of said compression mechanism;

a control sleeve externally fitted on said distribution member, said control sleeve being freely slidable in an axial direction and a circumferential direction relative to said distribution member, and said control sleeve comprising a hole that can communicate with said first through hole in synchronization with rotation of said distribution member;

a second actuator connected with and capable of displacing said control sleeve in the axial direction of said distribution member; and a pre-stroke control mechanism comprising:

a first link member rotatable around said axis of said distribution member concurrently with movement of said first actuator, a second link member having a first arm portion connected with said first link member so as to be rotated, concurrently with rotation of said first link member, around a position between said distribution member and said first actuator, and a third link member secured to said second link member and having a second arm portion connected with said control sleeve such that said third link member can rotate concurrently and concentrically with said second link member around the same center and cause said control sleeve to rotate concurrently with said second link member, wherein said second arm portion has a radius of rotation larger than a radius of rotation of said first arm portion.

2. A fuel injection control mechanism in a distributor type fuel injection system according to claim 1, wherein:

said first link member is mounted so as to rotate concurrently with said cam member and movement of said first actuator is communicated to said cam member and said second link member by said first link member.

3. A fuel injection control mechanism in a distributor type fuel injection system according to claim 1, wherein:

said first link member comprises a connecting and locking piece having an indented portion integral therewith; and said second link member comprises a base shaft portion supported by said pump housing, said first arm portion extending from said base shaft portion in a radial direction with respect to said base shaft portion, and an interconnecting projected portion formed on said first arm portion is connected to said indented portion of said first link member.

4. A fuel injection control mechanism in a distributor type fuel injection system according to claim 1, wherein:

said control sleeve comprises a groove extending in an axial direction of said control sleeve formed therein; and said third link member is externally fitted on said second link member and has said second arm portion connecting with said groove.

5. A fuel injection control mechanism in a distributor type fuel injection system according to claim 1, wherein:

an open end of said first through hole in said distribution member has a triangular shape with a trailing side in the direction of rotation being parallel to the axis of said distribution member and a leading side in the direction of rotation being inclined at a specific angle relative to the axis of said distribution member; and an open portion of said hole formed in said control sleeve and facing a circumferential surface of said distribution member is formed in a triangular shape, wherein a side for determining the timing of the beginning of communication with said open end of said first through hole is inclined at a specific angle relative to the axis of said distribution member, and a side for determining the timing of the end of communication with said opening end of said first through hole is parallel to the axis of said distribution member.

6. A fuel injection control mechanism in a distributor type fuel injection system according to claim 1, wherein:

said first actuator is movable in an advance direction corresponding to high speed, high load operation of an engine for setting a pre-stroke quantity at a low level and in a retard direction corresponding to low speed, medium-to-high load operation of said engine for setting said pre-stroke quantity at a high level.

7. A fuel injection control mechanism in a distributor type fuel injection system according to claim 1, wherein:

said cam member has transfer rate characteristics such that said transfer rate is low during an initial period of transfer and becomes high at approximately a middle period of transfer.

8. A fuel injection control mechanism in a distributor type fuel injection system, comprising:

a pump housing having a chamber formed therein;

a support member in said pump housing having fuel delivery distribution passages therein;

a fuel distribution member supported inside said pump housing in such a manner that said distribution member can rotate upon receiving a drive torque, said fuel distribution member being supported by said support member, having a longitudinal axis and having a compression space therein;

a plurality of plungers disposed radially relative to said distribution member and opposite each other so as to face each other and said compression space for varying the volumetric capacity of said compression space;

a cam member disposed around and concentric with said distribution member having an internal surface with cam surfaces thereon operatively engaging said plungers to radially reciprocate said plungers upon rotation of said distribution member;

a first through hole fluidly communicating said chamber formed inside said pump housing with said compression space and a second through hole formed in said distribution member that cyclically fluidly communicates said distribution passages with said compression space upon rotation of said distribution member;

a first actuator connected with said cam member such that said cam surfaces of said cam member can be shifted in a circumferential direction relative to said pump housing to adjust an advance angle state of said compression mechanism;

a control sleeve externally fitted on said distribution member, said control sleeve being freely slidable in an axial direction and a circumferential direction relative to said distribution member, and said control sleeve comprising a hole that can communicate with said first through hole in synchronization with rotation of said distribution member;

a second actuator connected with and capable of displacing said control sleeve in the axial direction of said distribution member; and a pre-stroke control mechanism comprising:

a first link member rotatable around said axis of said distribution member concurrently with movement of said first actuator, a second link member having a first arm portion connected with said first link member so as to be rotated, concurrently with rotation of said first link member, around a position between said distribution member and said first actuator, and a third link member secured to said second link member and having a second arm portion connected with said control sleeve such that said third link member can rotate concurrently and concentrically with said second link member around the same center and cause said control sleeve to rotate concurrently with said second link member, wherein said second arm portion has a radius of rotation larger than a radius of rotation of said first arm portion.

9. A fuel injection control mechanism in a distributor type fuel injection system according to claim 8, wherein:

said first link member is mounted so as to rotate concurrently with said cam member and movement of said first actuator is communicated to said cam member and said second link member by said first link member.

10. A fuel injection control mechanism in a distributor type fuel injection system according to claim 8, wherein:

said first link member comprises a connecting and locking piece having an indented portion integral therewith; and said second link member comprises a base shaft portion supported by said pump housing, said first arm portion extending from said base shaft portion in a radial direction with respect to said base shaft portion, and an interconnecting projected portion formed on said first arm portion is connected to said indented portion of said first link member.

11. A fuel injection control mechanism in a distributor type fuel injection system according to claim 8, wherein:

said control sleeve comprises a groove extending in an axial direction of said control sleeve formed therein; and said third link member is externally fitted on said second link member and has said second arm portion connecting with said groove.

12. A fuel injection control mechanism in a distributor type fuel injection system according to claim 8, wherein:

an open end of said first through hole in said distribution member has a triangular shape with a trailing side in the direction of rotation being parallel to the axis of said distribution member and a leading side in the direction of rotation being inclined at a specific angle relative to the axis of said distribution member; and an open portion of said hole formed in said control sleeve and facing a circumferential surface of said distribution member is formed in a triangular shape, wherein a side for determining the timing of the beginning of communication with said open end of said first through hole is inclined at a specific angle relative to the axis of said distribution member, and a side for determining the timing of the end of communication with said opening end of said first through hole is parallel to the axis of said distribution member.

13. A fuel injection control mechanism in a distributor type fuel injection system according to claim 8, wherein:

said first actuator is movable in an advance direction corresponding to high speed, high load operation of an engine for setting a pre-stroke quantity at a low level and in a retard direction corresponding to low speed, medium-to-high load operation of said engine for setting said pre-stroke quantity at a high level.

14. A fuel injection control mechanism in a distributor type fuel injection system according to claim 8, wherein:

said cam member has transfer rate characteristics such that said transfer rate is low during an initial period of transfer and becomes high at approximately a middle period of transfer.

* * * * *